United States Patent [19]

Fewel

[11] 4,387,539

[45] Jun. 14, 1983

[54] VIBRATORY ACTUATOR

[75] Inventor: Kenneth J. Fewel, Nacogdoches, Tex.

[73] Assignee: The Hutson Corporation, North Mansfield, Tex.

[21] Appl. No.: 248,802

[22] Filed: Mar. 30, 1981

[51] Int. Cl.[3] ..... B24B 31/00

[52] U.S. Cl. ..... 51/163.2; 366/128; 384/107

[58] Field of Search ..... 51/163.1, 163.2, 164.1, 51/164.5; 366/128; 308/230, 9

[56] References Cited

U.S. PATENT DOCUMENTS

| | | | |
|---|---|---|---|
| Re. 20,305 | 3/1937 | Klahn . | |
| Re. 27,412 | 6/1972 | Olson et al. . | |
| 830,349 | 9/1906 | Meurer . | |
| 1,057,773 | 4/1913 | Pratt . | |
| 1,548,545 | 8/1925 | Niederhauser . | |
| 1,647,249 | 11/1927 | Podszus . | |
| 1,901,122 | 3/1933 | Robins | 51/163.1 X |
| 2,350,334 | 6/1944 | Baker . | |
| 2,426,351 | 8/1947 | Jeffrey | 308/230 X |
| 2,470,340 | 5/1949 | Cook et al. . | |
| 2,549,561 | 4/1951 | Baker . | |
| 2,722,840 | 11/1955 | Kececioglu . | |
| 2,729,518 | 1/1956 | O'Connor . | |
| 2,818,184 | 12/1957 | Matson . | |
| 2,923,104 | 2/1960 | Olson et al. . | |
| 2,983,454 | 5/1961 | Podmore, Jr. et al. . | |
| 3,015,523 | 1/1962 | Semar . | |
| 3,049,383 | 8/1962 | Loch . | |
| 3,084,876 | 4/1963 | Podmore . | |
| 3,100,088 | 8/1963 | Podmore et al. . | |
| 3,151,620 | 10/1964 | Kellard . | |
| 3,214,871 | 11/1965 | Olson et al. . | |
| 3,260,509 | 7/1966 | Rudy . | |
| 3,266,739 | 8/1966 | McKibben . | |
| 3,268,177 | 8/1966 | McKibben | 51/163.2 X |
| 3,305,977 | 2/1967 | Kellard . | |
| 3,356,302 | 12/1967 | Podmore . | |
| 3,395,948 | 8/1968 | Andrews . | |
| 3,456,992 | 6/1969 | Kulina . | |
| 3,539,116 | 11/1970 | Podmore et al. . | |
| 3,650,582 | 3/1972 | Casey . | |
| 3,707,058 | 12/1972 | Anderson et al. . | |
| 3,724,146 | 4/1973 | Fahey et al. . | |
| 3,747,470 | 7/1973 | Inoue et al. . | |
| 3,747,639 | 7/1973 | Eickmann . | |
| 3,753,016 | 8/1973 | Klein . | |
| 3,777,770 | 12/1973 | Cunningham-Smith . | |
| 3,785,708 | 1/1974 | Miyasaki . | |
| 3,814,335 | 6/1974 | Fahey et al. . | |
| 3,954,309 | 5/1976 | Hutson et al. . | |

FOREIGN PATENT DOCUMENTS

| | | |
|---|---|---|
| 834959 | 5/1960 | United Kingdom . |
| 1130143 | 10/1968 | United Kingdom . |
| 1233140 | 5/1971 | United Kingdom . |
| 1351432 | 5/1974 | United Kingdom . |
| 1435499 | 5/1976 | United Kingdom . |
| 1449370 | 9/1976 | United Kingdom . |

*Primary Examiner*—James G. Smith
*Assistant Examiner*—Debra S. Meislin
*Attorney, Agent, or Firm*—Richards, Harris & Medlock

[57] ABSTRACT

An actuator (22) for a vibratory finishing machine or the like includes a housing (24) with a rotatable quill shaft (44) of comparatively low bending stiffness extending therethrough. Mounted on each end of the quill shaft (44) is a journal (46) which defines a hydrodynamic bearing with an adjacent corresponding internal surface of the housing (24). The quill shaft (44) is axially constrained within the housing (24) by an inward thrust bearing (68) and an outward retainer (56), dynamic seal (64), static seal (62) and spring (66) located on opposite sides of each journal (46).

13 Claims, 4 Drawing Figures

VIBRATORY ACTUATOR

TECHNICAL FIELD

The present invention relates generally to an actuator for a vibratory machine, and more particularly to a vibratory actuator including a quill shaft of relatively low stiffness supported in a rigid housing by improved hydrodynamic journal bearing structure so as to accommodate end thrust loads without excessive heat and wear.

BACKGROUND ART

Vibratory devices are used in many applications to perform a wide variety of functions. A vibratory finishing machine, for example, generally includes a movable tub or bowl mounted on a fixed base. Piece parts to be finished are loaded into the tub or bowl together with a suitable finishing media, which typically comprises a mixture of abrasive material and liquid, such as water, and an optional finishing agent. As the tub is vibrated with an eccentric actuator mounted thereon, relative movement between the piece parts and finishing media causes performance of the desired deburring, burnishing, polishing or other finishing operation on the parts.

The eccentric actuators typically employed with such machines include either a rotatable shaft with eccentric weights mounted thereon, or simply a rotatable eccentric shaft. In either case the shaft of the eccentric actuator can be supported by antifriction bearings of the ball, roller, tapered roller or needle type; however, several problems have arisen in the use of bearings with rolling and nonrolling elements in such applications. The useful lives of such bearings are relatively short because repeated radial loads cause fatigue and localized heat buildup leading to early bearing failure. Replacement of the bearings supporting eccentric actuators has been a continual and persistent problem in the use of vibratory machines.

More recently, hydrodynamic bearings have been developed for supporting the eccentric actuator of a vibratory machine. Such bearings utilize a thin film of fluid between certain moving parts to reduce the fatigue and heating problems otherwise accompanying direct mechanical contact between the parts. Circulation of the fluid has been especially effective in controlling heat buildup in such bearings, however, sudden bearing failure can occur if the proper hydrodynamic film is not maintained. Maintenance of sufficient fluid film thus has been of critical importance to the operation of hydrodynamic bearings.

U.S. Pat. No. 3,954,309 assigned to the assignee hereof, discloses a vibratory actuator which incorporates the principle of deflection matching between the shaft and the housing within which the hydrodynamic bearings are supported to faciliate maintenance of sufficient fluid film by minimizing structural deflection and misalignment. This device, although effective, is axially supported at opposite outboard ends and some difficulties from excessive end thrust have been experienced. In addition, this approach requires precise engineering analysis and construction to match the stiffnesses of the shaft and housing, and requires precise machining to make coaxial bearings concentric and in line, which in turn results in extra weight and cost.

A need thus exists for an improved vibratory actuator which by simple means assures deflection matching between the shaft and housing while facilitating maintenance of the proper fluid film in the hydrodynamic bearings, which permits greater latitude for errors in concentricity and alignment of coaxial bearings, and which further provides axial support for the shaft to accommodate end thrust loads without excessive heat and wear.

SUMMARY OF INVENTION

The present invention comprises an improved vibratory actuator which overcomes the foregoing and other difficulties associated with the prior art. The actuator herein includes a tubular housing adapted for connection to the tub or bowl of a vibratory finishing machine. Extending through the housing is a quill shaft supported at opposite ends of the housing by hydrodynamic bearings. The quill shaft is substantially less stiff in bending than is the rigid outer housing in order to conform to defections of the housing. The journal members at the ends of the shaft are each supported between a retainer and seal arrangement and a thrust bearing. A spring loader seal is provided between an upset portion of each journal member and the corresponding retainer. Ports and passageways are provided in the housing for circulating hydrodynamic fluid through annular spaces between the journals and housing to maintain a proper film within the hydrodynamic bearings. Weight carriers are mounted on opposite ends of the shaft for centrally supporting eccentric weights over the journal members to effect vibratory actuation upon rotation of the shaft.

BRIEF DESCRIPTION OF DRAWINGS

A better understanding of the invention can be had by referring to the following Detailed Description in conjunction with the accompanying Drawings, wherein.

DETAILED DESCRIPTION

Figure 1:
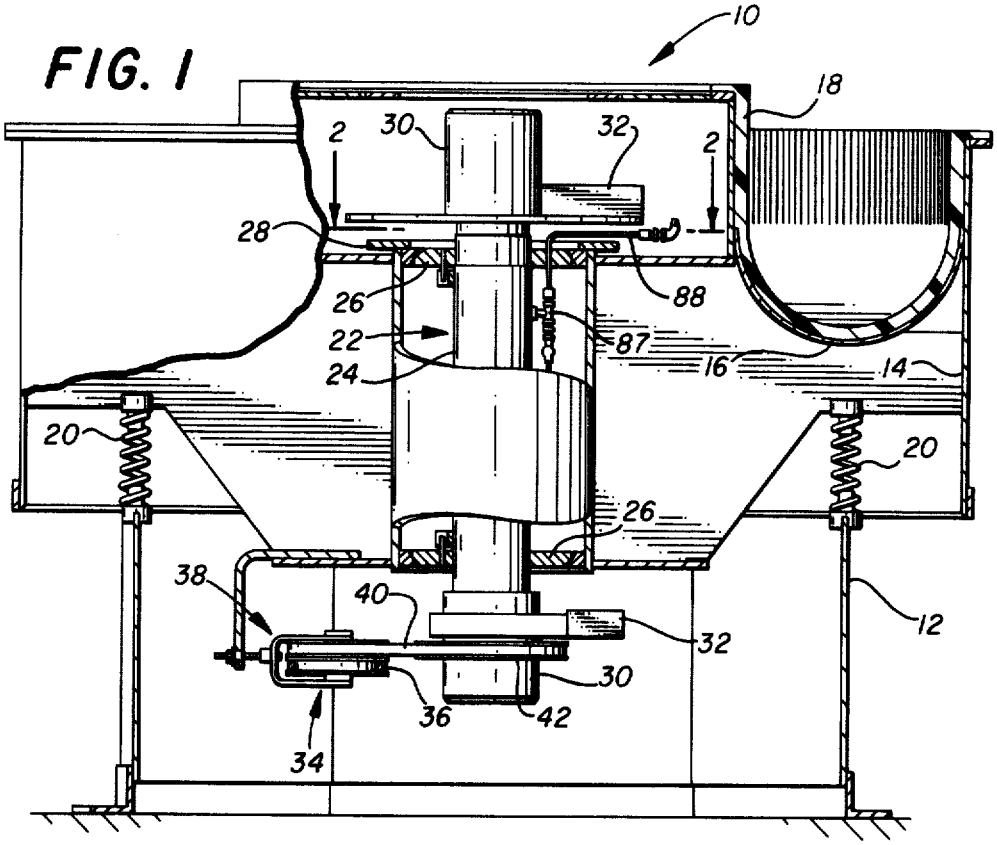
FIG. 1 is an elevational view (partially cutaway) of a vibratory finishing machine incorporating the actuator of the invention.

Referring now to the Drawings, wherein like reference numerals designate corresponding elements throughout the views, FIG. 1 shows a vibratory finishing machine 10 with which the actuator herein is particularly adapted to be used. As illustrated, machine 10 comprises a vibratory finishing machine of the bowl type suitable for performing deburring, polishing and other surface treatment operations on piece parts. Machine 10 includes a fixed base 12 supporting a movable frame 14 to which a bowl 16 is secured. Bowl 16 is of a toroidal form as illustrated, however, the bowl could be in the shape of a tub. A liner 18 of polyurethene or other suitable wear resistant material can be provided on the interior surface of bowl 16 to reduce wear during operation of machine 10. Base 12 and frame 14 are interconnected by a plurality of springs 20 to isolate gyration of bowl 16 and the frame from the base. Springs 20 are illustrated as coil springs; however, air bags, elastomeric springs or other resilient mountings could also be employed.

Machine 10 further includes a vibratory actuator 22 incorporating the invention. Actuator 22 includes a rigid housing 24 with a pair of circular collars 26 thereon by which the actuator is secured to frame 14. As illustrated, the collars 26 include inclined peripherys for engagement with corresponding plates on frame 14, with the actuator 22 being axially secured in place by means of a retainer ring 28. Extending through housing 24 is a quill shaft (not shown in FIG. 1), with a weight carrier 30 and eccentric weight 32 secured to each end of the shaft. The eccentricities of weights 32 are preferably adjustable so that vibrational amplitude can be varied in accordance with the particular finishing operation.

Actuator 22 is driven by a drive system 34, only a portion of which has been shown in FIG. 1 for clarity. Drive system 34 can be constructed in accordance with my copending application Ser. No. 244,100, filed Mar. 16, 1981 and entitled FLEXIBLE DRIVE SYSTEM FOR VIBRATORY APPARATUS the disclosure of which is hereby incorporated by reference; however, other suitable drive systems can be utilized. A first belt 36 couples the drive pulley of a drive motor (not shown) to the dual idler pulley of an idler assembly 38, which in turn is connected by a second belt 40 to a driven pulley 42 mounted on the bottom carrier 30 of actuator 22.

Piece parts to be finished are first placed in bowl 16 of machine 10 together with a liquid media and abrasive, and, in some cases, a finishing agent. The piece parts can be arranged loosely within bowl 16 or suspended on racks or the like. The actuator 22 is then driven with drive system 34 to effect vibration of the piece parts and media within bowl 16 to accomplish the desired operation, at the conclusion of which the finished parts and used media can be removed from machine 10.

Figure 2:
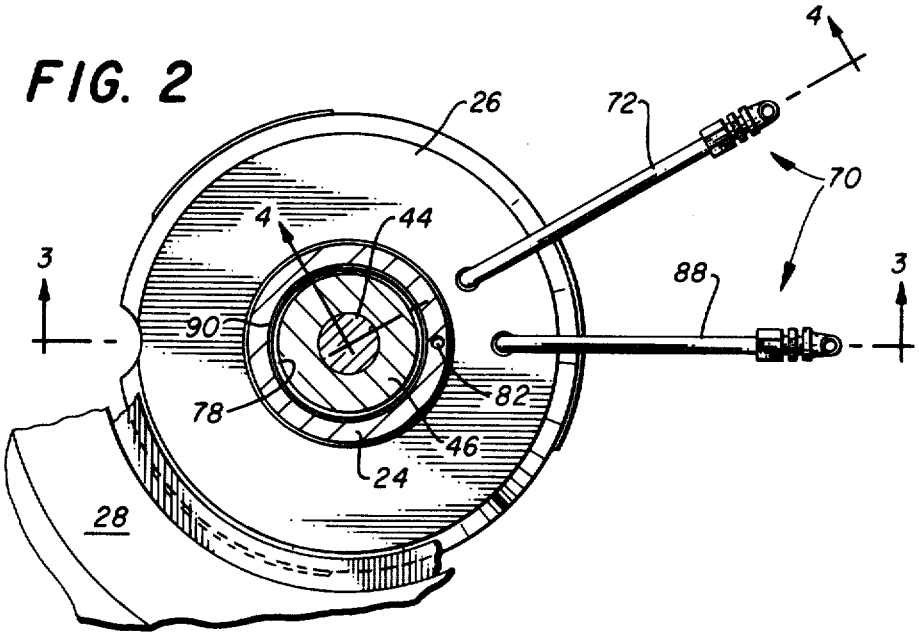
FIG. 2 is a sectional view taken along lines 2—2 of FIG. 1 in the direction of the arrows.
Figure 3:
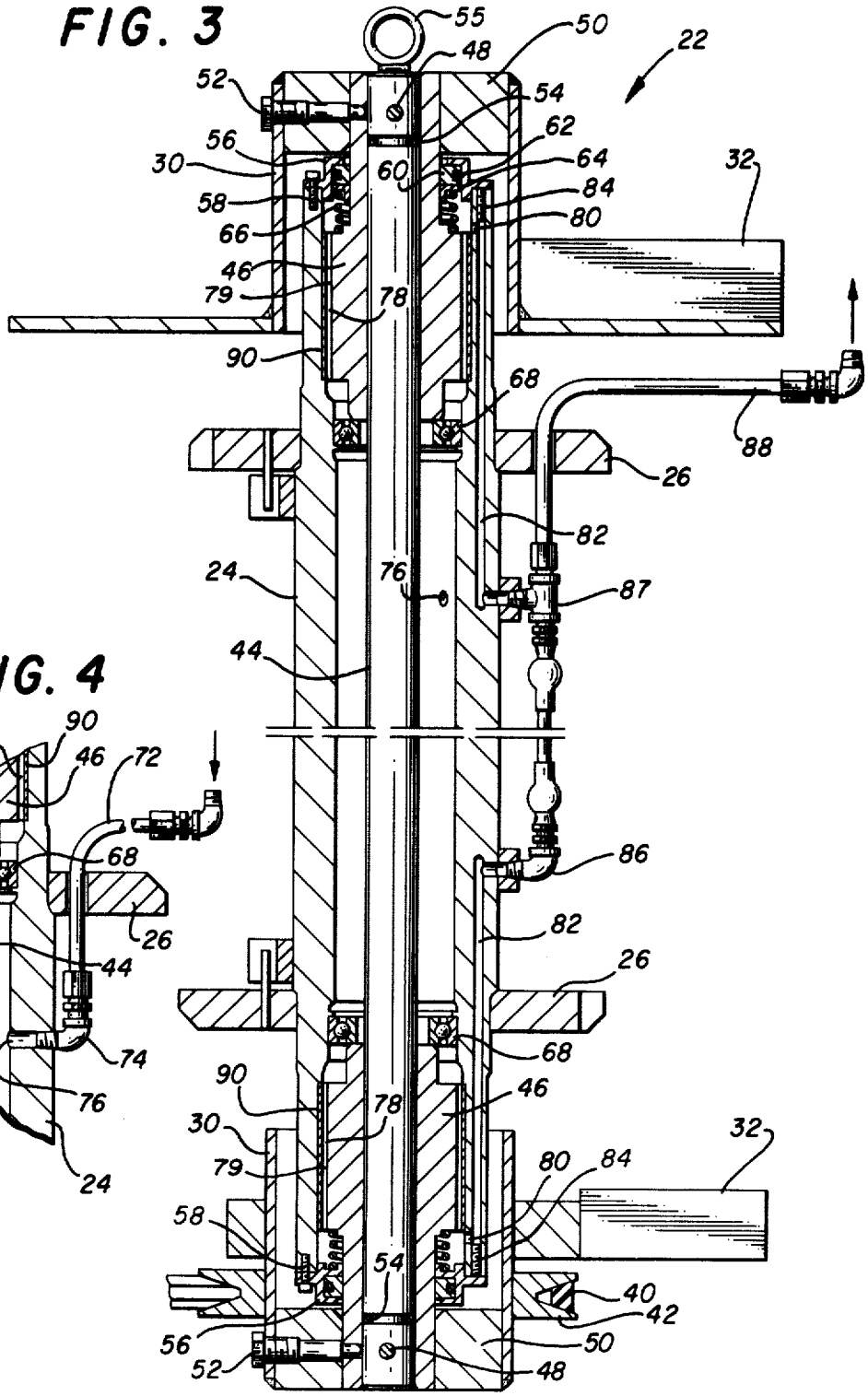
FIGS. 3 and 4 are sectional views taken respectively along lines 3—3 and 4—4 of FIG. 2 in the direction of the arrows.
Figure 4:
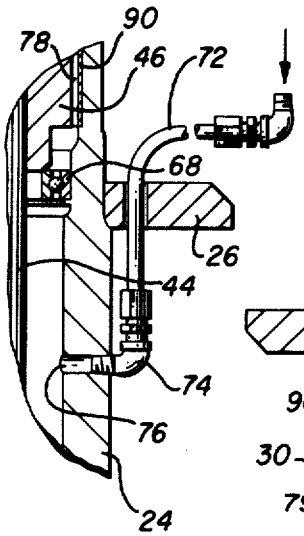

The structural details of the vibratory actuator 22 are best shown in FIGS. 2–4. Referring primarily to FIG. 3, actuator 22 includes a quill shaft 44 which extends completely through housing 24 and which is of substantially less bending stiffness than the housing. For example, the shaft bending stiffness is preferably less than 1–2% of the stiffness of the housing. In other words, the bending stiffness of quill shaft 44 is miniscule relative to that of housing 24. In one commercial embodiment of the invention, for instance, the ratio of the moments of inertia of the shaft to the housing $I_S/I_H$ is 0.45%. This comprises an important feature of the invention, the significance of which will be explained more fully hereinafter. Shaft 44 is preferably solid but can be either solid or hollow.

Both ends of the quill shaft 44 are configured alike and supported by identical hydrodynamic bearings. Each end of shaft 44 includes a cylindrical journal 46 which is affixed to the shaft with a pin 48. Journals 46 are approximately 0.0030–0.0035 inch smaller in diameter than the corresponding adjacent internal surface of housing 24, or are otherwise suitably dimensioned to define a hydrodynamic fluid annulus. End pieces 50 of weight carriers 30 are secured to journals 46 for rotation with shaft 44 by shear pins 52. An O-ring 54 is provided between shaft 44 and each journal 46 to provide a static seal. An eyelet 55 can be provided at the upper end of shaft 44 to facilitate installation or removal of actuator 22 in machine 10.

Provided at each end of housing 24 is a retainer 56 which is secured to the housing by means of bolts 58 or other suitable fasteners. Retainers 56 are dimensioned to surround the reduced portions of journal 46 in spaced relationship, thereby allowing for deflection between housing 24 and shaft 44. A conventional face seal assembly is located inward of each retainer 56. Stationary seats 60 are positioned immediately inside retainers 56. A static seal 62, which can comprise a conventional O-ring, is provided between each seat 60 and corresponding retainer 56. A rotating face seal 64 is provided immediately inward of each seat 60, with a coil spring 66 being positioned between the face seal and a shoulder formed on the corresponding journal 46. Springs 66 therefore function to preload seats 60 and face seal 64 and urge them axially outward.

Although actuator 22 has been illustrated with face seal assemblies incorporating springs, lip seals or other suitable seals can be utilized.

The innermost ends of journals 46 are axially supported on thrust bearings 68 which are seated on annular shoulders machined into the interior surface of housing 24. Bearings 68, which can comprise conventional thrust bearings of the rolling element type, are dimensioned to surround the quill shaft 44 in spaced relationship and provide only axial mechanical support for the shaft. Bearings 68 thus also allow for relative deflection between shaft 44 and housing 24.

In the preferred embodiment, the thrust bearings 68 are located inward of journals 46, however, the positions of these components can be outboard of the journals if desired.

Actuator 22 further includes a lubrication system 70 by which pressurized fluid, such as oil or other suitable lubricant, is circulated through the actuator. Fluid from a reservoir is pumped via a feedline 72 to a fitting 74 connected to the outside of a port 76 extending through housing 24. The interior space between housing 24 and shaft 44 is thus filled with lubricating fluid which in turn is forced past thrust bearing 68 and into an annulus 78 between each journal 46 and corresponding bearing portion of the housing. A flat 79, which can be about 0.05 inch deep or of other suitable depth, is preferably machined on the unloaded back side of each journal 46; however, an axial hole through the journal could also be used to allow flow and thus cooling of the hydrodynamic bearings. A notch, radial hole or groove 80 is formed in housing 24 immediately adjacent to the outermost end of each journal 46. Grooves 80 in turn open onto axial fluid passageways 82 drilled in housing 24. The outer ends of passageways 82 are closed by plugs 84, while the inner ends are ported to fittings 86 and 87 which connect to a return line 88 for conveying the fluid back to the reservoir. If desired, liners 90 of bronze or other suitable material can be press fitted into the bearing portions at the opposite ends of housing 24 for increased wear resistance.

In the operation of vibratory actuator 22, shaft 44 is driven via belt 40 and pulley 42 thereby rotating the shaft and eccentric weights 32 thereon to effect vibration. Simultaneously, of course, oil or other suitable lubricant is being forced through port 76 into housing 24 and outward to feed hydrodynamic films being generated between the rotating journals 46 and stationary bearing portions of the housing. Those skilled in the art will appreciate the fact that the viscous shear forces generated within the hydrodynamic bearings help draw lubricant between the journals 46 and housing 24. As shaft 44 rotates, the rotating eccentric weights 32, which are preferably centered over journals 46 and the hydrodynamic bearings, continuously generate on opposite ends of the shaft radial forces which form a moment causing the shaft and housing 24 to assume a slightly bowed configuration as it rotates. Due to its reduced bending stiffness, shaft 44 deflects in accordance with the housing deflection so that a substantially symetrical pressure distribution is maintained in the hydrodynamic bearings. The hydrodynamic bearings at both ends of shaft 44 completely support these radial loads and distribute them from the shaft into housing 24 from which they are in turn distributed to frame 14, thereby effecting vibration of the piece parts and abrasive media within bowl 16.

From the foregoing, it will be appreciated that the present invention comprises an eccentric actuator for a vibratory apparatus which has numerous advantages over the prior art. The invention herein features simplified and less expensive construction, and automatically provides for precise deflection matching between the shaft and housing while maintaining sufficient film for the hydrodynamic journal bearings. Other advantages will be evident to those skilled in the art.

Although particular embodiments of the invention have been illustrated in the Drawings and described in the Detailed Description, it will be understood that the invention is not limited to the embodiments disclosed, but is intended to embrace any alternatives, modifications, rearrangements and/or substitutions of elements falling within the scope of the invention as defined by the following claims.

I claim:

1. A vibratory actuator, comprising:

a tubular housing having a predetermined bending stiffness;

a rotatable quill shaft extending longitudinally through said housing, said shaft having a maximum bending stiffness which does not exceed 2% of the predetermined bending stiffness of said tubular housing such that said housing and said shaft have unmatched deflection characteristics;

a pair of journal members secured to said shaft in spaced apart relationship, said journal members having cylindrical external surfaces dimensioned to define hydrodynamic bearings with adjacent corresponding internal surfaces of said housing;

thrust bearing means positioned inward of each journal member for axially supporting said journal members and said shaft within said housing;

a retainer positioned outward of each journal member and secured to said housing in surrounding spaced apart relationship with said shaft;

seal means positioned between each retainer and corresponding journal member for closing said housing and circumferentially engaging said shaft;

eccentric weight means secured to said shaft and located exterior of said housing centered over each journal member for effecting vibration upon rotation of said shaft; and means for directing lubricant to the hydrodynamic bearings between said journal members and said housing.

2. The vibratory actuator of claim 1, wherein the shaft to housing bending stiffness ratio is about 2% or less.

3. The vibratory actuator of claim 1, wherein said eccentric weight means comprises:

a carrier;

a shear pin securing said carrier to said shaft; and an eccentric weight secured to said carrier.

4. A vibratory actuator, comprising:

a tubular housing of predetermined bending stiffness;

a rotatable shaft extending longitudinally through said housing, said shaft being of miniscule bending stiffness relative to that of said housing;

a pair of journal members secured to said shaft in spaced apart relationship, said journal members having cylindrical external surfaces dimensioned to define hydrodynamic bearings with adjacent corresponding internal surfaces of said housing;

thrust bearing means positioned inward of each journal member for axially supporting said journal members and said shaft within said housing;

a retainer positioned outward of each journal member and secured to said housing in surrounding spaced apart relationship with said shaft;

seal means positioned between each retainer and corresponding journal member for closing said housing and circumferentially engaging said shaft;

eccentric weight means secured to said shaft and located exterior of said housing centered over each journal member for effecting vibration upon rotation of said shaft; and means for directing lubricant to the hydrodynamic bearings between said journal members and said housing;

each of said seal means comprising:

a seat abutting one side of said corresponding retainer and circumferentially engaging said shaft;

a static seal disposed between said seat and corresponding retainer;

a face seal abutting said seat and circumferentially engaging said shaft; and a spring disposed between said face seal and corresponding journal member.

5. The vibratory actuator according to claim 4, wherein each of said spring means comprises:

a compression spring coiled about a portion of said corresponding journal member.

6. The vibratory actuator of claim 1, further including:

an eyelet secured to one end of said shaft.

7. A vibratory finishing machine, comprising:

a base;

a bowl for receiving piece parts to be finished and suitable finishing media;

means for resiliently supporting said bowl on said base; and a vibratory actuator connected to said bowl for effecting vibration thereof, said actuator comprising:

a tubular housing;

a rotatable shaft extending longitudinally through said housing;

a pair of journal members secured to said shaft in spaced apart relationship, said journal members having cylindrical external surfaces dimensioned to define hydrodynamic bearings with adjacent corresponding internal surfaces of said housing;

a retainer positioned outward of each journal member and secured to said housing in spaced apart relationship with said shaft;

seal means positioned between each retainer and corresponding journal member for closing said housing and sealingly engaging said shaft;

eccentric weight means secured to said shaft and located exterior of said housing centered over each journal member for effecting vibration upon rotation of said shaft; and means for providing lubricant to the hydrodynamic bearings between said journal members and said housing;

each of said seal means comprising:

a seat abutting one side of said corresponding retainer and circumferentially engaging said shaft;

a static seal disposed between said seat and corresponding retainer;

a face seal abutting said seat and circumferentially engaging said shaft; and a spring disposed between said face seal and corresponding journal member.

8. A vibratory actuator for use with hydrodynamic fluid, comprising:

a tubular housing;

a rotatable shaft extending longitudinally through said housing;

a pair of journal members secured to said shaft in axially spaced apart relationship, said journal members having cylindrical external surfaces dimensioned to define hydrodynamic bearings with adjacent corresponding internal surfaces of said housing;

thrust bearing means positioned adjacent one side of each journal member for axially supporting said journal members and said shaft within said housing;

a retainer positioned adjacent the other side of each journal member and secured to said housing in surrounding spaced apart relationshp with said shaft;

a seat positioned inward of each retainer in surrounding engagement with said shaft and abutting engagement with said corresponding retainer;

a static seal disposed between each seat and corresponding retainer;

a face seal positioned inboard of each seat in surrounding engagement with said shaft and abutting engagement with said corresponding seat;

spring means disposed between each face seal and corresponding journal member for axially urging said seals outward against said retainers and thereby preloading said bearings;

eccentric weight means secured to said shaft and centered over each journal member for effecting vibration upon rotation of said shaft; and means for directing lubricant to the hydrodynamic bearings between said journal members and said housing.

9. The vibratory actuator of claim 8, wherein the shaft to housing bending stiffness ratio is about 2% or less.

10. The vibratory actuator of claim 8, wherein each journal member includes a reduced portion pinned to an end of said shaft and an upset portion located inside an end of said housing, and wherein said retainers are secured to the ends of said housing in surrounding spaced relationship with the reduced portions of said journal members.

11. The vibratory actuator of claim 8, wherein each of said spring means comprises:

a compression spring coiled about a portion of said corresponding journal member.

12. The vibratory apparatus of claim 8, further including:

a bronze liner secured to the corresponding internal surface of said housing adjacent to each journal member.

13. The vibratory apparatus of claim 8, wherein an exterior portion of each journal member located opposite the corresponding eccentric weight means includes a longitudinal flat to facilitate circulation of hydrodynamic fluid through the hydrodynamic bearings.

* * * * *